United States Patent [19]

Ehmann

[11] 4,140,000

[45] Feb. 20, 1979

[54] PLIERS-TYPE TOOL FOR SETTING BLIND-RIVET NUTS

[75] Inventor: Hans Ehmann, Frankfurt am Main, Fed. Rep. of Germany

[73] Assignee: GESIPA Blindniettechnik GmbH, Frankfurt am Main, Fed. Rep. of Germany

[21] Appl. No.: 794,248

[22] Filed: May 5, 1977

[51] Int. Cl.[2] ..... B21J 15/34

[52] U.S. Cl. ..... 72/35; 72/114

[58] Field of Search ..... 72/114, 391, 409, 32, 72/35, 36

[56] References Cited

U.S. PATENT DOCUMENTS

| | | | |
|---|---|---|---|
| 3,461,713 | 8/1969 | Donath | 72/409 |
| 3,587,271 | 6/1971 | Rigot | 72/114 |
| 3,762,200 | 10/1973 | Still | 72/114 |
| 3,782,165 | 1/1974 | Bosch | 72/391 |
| 3,933,019 | 1/1976 | Underland | 72/114 |

FOREIGN PATENT DOCUMENTS

| | | | |
|---|---|---|---|
| 894758 | 3/1944 | France | 72/35 |

*Primary Examiner*—C. W. Lanham
*Assistant Examiner*—Gene P. Crosby
*Attorney, Agent, or Firm*—Montague & Ross

[57] ABSTRACT

A tool for setting internally threaded blind-rivet nuts comprises a pliers-type structure having a fixed arm having at one end thereof a hammerhead housing formed with a bore in which a pulling piece is linearly guided. A mandrel having an external threaded part for screwing into a blind-rivet nut removably clamped in this pulling member and can be dislodged by forcing it through the pulling member and out of the end remote from the end of the head at which the blind-rivet nut is to be set. The housing is formed with a stop screw which can be indexed in place to limit the displacement of a movable arm on the housing which arm is connected with the pulling member and establishes the stroke thereof.

11 Claims, 13 Drawing Figures

PLIERS-TYPE TOOL FOR SETTING BLIND-RIVET NUTS

FIELD OF THE INVENTION

The present invention relates to a manually operated riveting pliers for setting blind rivet nuts. The tool comprises a housing formed with a nose piece and terminating in a fixed arm, a further arm supported for rotation on the housing and acting directly or via an intermediate member articulated to it on the pull mechanism which is displaceable in the housing in order to set blind rivet nuts, the connecting piece being also of articulated development and the pull mechanism having a threaded mandrel of adjustable length which extends out of the nose piece and onto which the blind-rivet nut can be screwed.

BACKGROUND OF THE INVENTION

Blind rivet nuts and manual riveting tongs or pliers for setting them are already known. The blind rivet nut consists of a hollow rivet with an internal thread (inner screwhead) which has a setting head or setting flange (rivet nut head). The internal thread does not extend over the entire length of the hollow rivet but, corresponding to the size of the hollow rivet or to the thickness of the material to be worked, commences at a certain amount below the head. The manual riveting tool has a threaded mandrel which extends by an adjustable amount out of the housing and onto which the blind rivet nut is screwed. After the rivet nut has been inserted into the hole intended for the riveting the pull mechanism which bears the threaded mandrel is withdrawn into the housing by manipulating the arms and an annular bead is formed on the rivet nut as counterpart to the manufactured head on the other side of the workpiece which is to be worked. The threaded mandrel is then screwed out of the blind rivet nut which has been set. In this way one can produce a rivet connection between two or more workpieces, onto which a further part can, by means of the internal thread of the blind rivet nut, also be detachably fastened by a screw. In addition the blind rivet nut can also be set in a single workpiece, for instance a plate, in order to create the prerequisites for the threaded attachment of another part to this workpiece. The threaded mandrel is available of course in different thread sizes corresponding to the blind-rivet nuts, for instance in the DIN range of M3 to M6; it must thus be replaceable.

One great disadvantage of the known manual riveting tools for the setting of blind-rivet nuts is that they have an invariable actuating stroke, which is the longest required. Since a smaller thickness of workpiece material requires a larger stroke and a larger thickness of material requires a smaller stroke, the operator had to proceed intuitively when using the known manual riveting. The two tong arms had to be squeezed together until the annular bead was formed on the rivet nut on the opposite side of the workpiece, which side is generally not visible; relative displacement of the arms then was required to stop since otherwise the pull mandrel would tear off the thread of the nut. Since the operator had to proceed in accordance with a sense of feel in order to determine the time when the annular bead was formed, rapid work was impossible and defective rivetings constantly resulted due either to the fact that the blind rivet nut was not actually seated firmly because one proceeded too cautiously or to the fact that the thread of the rivet nut was damaged. In order that the thread of the rivet nut be uniformly acted upon during the riveting, the threaded mandrel should always extend out of the housing to such an extent that all threads of the blind rivet nut can be acted on. Corresponding to the different lengths of the rivet nuts the threaded mandrel extending out of the housing of the tongs can therefore be adjusted and fixed in length. For this purpose, a tool, for instance a wrench, is necessary with the known manual riveting tongs, which constitutes a disadvantage. The operation of the known manual riveting tongs is furthermore made difficult by the fact that the replacement of the threaded mandrels is also very complicated and is possible only with the use of special tools.

OBJECT OF THE INVENTION

The object of the present invention is to provide a manual riveting tongs or pliers for the setting of blind-rivet nuts which is simple to operate and permits rapid and errorless work. For this purpose, the actuating stroke of the tongs should be able to be adapted to the thickness of material to be worked and the blind rivet nut selected for same. Furthermore, simple and rapid adjustment and replacement of the threaded mandrels corresponding to the size of the blind-rivet nuts to be riveted should be possible without the use of special tools.

SUMMARY OF THE INVENTION OBJECT

In accordance with the invention, this object is achieved by providing that the opening angle of the movable arm of the tongs or plier-like tool with respect to the fixed tong housing can be varied by means of a stop device and locked, the pull mechanism having a pull rod which bears the threaded mandrel and which is detachably connected by a clamp attachment to a pull piece which is displaceable in the housing of the tongs.

In the bottom of the tong housing, which is developed in known manner in U-shape, below the part of the tongs acting on the thread mechanism for the working of blind rivet nuts, there is preferably recessed a threaded bushing into which a stop screw is adjustably screwed, the part acting on the thread mechanism resting on said screw.

The stop screw can have a knurled nut with the knurling of which a pin-shaped detent spring extending out of the bottom of the housing of the tongs is in engagement.

In another embodiment of the invention, the stop screw also has a knurled nut and a helically wound coil spring is provided between the bottom of the housing and the bottom of the knurled nut.

By coating the helically wound coil spring with plastic, the stop screw can furthermore be made difficultly movable.

In one particularly advantageous embodiment of the invention, a stroke-value scale is provided on the face side of the knurled nut and a pointer cooperating with the stoke-value scale is provided on the housing of the tongs.

The clamping attachment in accordance with the invention between the pull rod which bears the threaded mandrel and the pull member which is displaceable in the tong housing is obtained, in one embodiment of the invention, by providing the pull piece, which is displaceable in the tong housing with a central bore to receive the pull rod with little play and has on its circumference an annular groove with a bore to receive a ball. The ball under the action of a leaf spring surrounding the annular groove extends partially into the central bore. The pull rod is also provided on its periphery with an annular groove which in the assembled condition of the pull rod lies in the same plane as the annular groove of the pull piece so that the ball snaps into the annular groove of the pull rod and produces the clamping attachment.

The prevent turning a securing pin can be provided at the open place of the leaf spring which surrounds the annular groove of the pull piece.

The two bores are preferably diametrically opposite each other, namely the bore which receives the ball and the one receiving the securing pin.

In another embodiment of the invention, the clamping attachment is obtained by providing the pull piece which is displaceable in the housing of the tongs with a central bore to receive the connecting rod with only slight clearance; the central bore has, at least in a limited region, a fine-machined smooth surface and the pull rod is provided on its periphery in the region which in its mounted condition comes to lie in the region of the finely-machined smooth surface, with an annular groove into which an annular spring of circular cross section is inserted, and this annular spring has a diameter which takes up the play between the finely machined surface of the bore and the pull rod so as to produce a clamping action.

The finely machined surface and the annular groove with the annular spring are preferably provided in the upper region of the borehole and of the pull rod respectively.

In one embodiment of the manual riveting tongs in accordance with the invention, the nose piece can be screwed by means of an external thread into a head part of the tong housing, which has a hammer shape, and can be locked to the head part by means of a lock nut provided on its outer thread in any axial position with respect to the head part and the threaded mandrel.

By the present invention, the operation and handling of the manual riveting tongs for the setting of blind-rivet nuts is considerably simplified as compared with the known tools. It permits rapid errorless operation. As a result of the possibility of adjusting the stroke in accordance with the thickness of the material and the blind-rivet nuts selected for same, the operator is no longer dependent on his sense of feel when effecting the riveting; with proper adjustment of the stroke, the riveting process terminates as soon as the annular bead has been formed as a counterpart to the manufactured head. The thread of the blind-rivet nut can no longer be damaged.

By means of the stop screw which serves for adjusting the stroke and can be actuated by hand the tongs can advantageously be locked in a closed position.

While in the known tools the replacement of the threaded mandrel was possible only in cumbersome fashion and with the use of special tools (i.e., the threaded mandrel had to be unscrewed), in the manual riveting tongs of the invention, a slight blow or oppositely directed pressure (from the bottom) on the threaded mandrel is sufficient and the clamp attachment of the invention is thereby loosened to such an extent that the threaded mandrel together with the pull rod bearing it can be pulled out in simple fashion towards the rear. The new threaded mandrel can be inserted just as simply from the rear and the clamping attachment produced by a slight pressure.

The adjusting of the length of the threaded mandrel extending out of the nose piece in accordance with the length of the selected blind-rivet nut can be effected in simple manner by means of the screwable mouthpiece with lock nut by hand and therefore without wrench or other tool.

BRIEF DESCRIPTION OF THE DRAWING

The invention will be described in further detail below with reference to the accompanying drawing in which.

Specific Description

Figures 1, 1A:
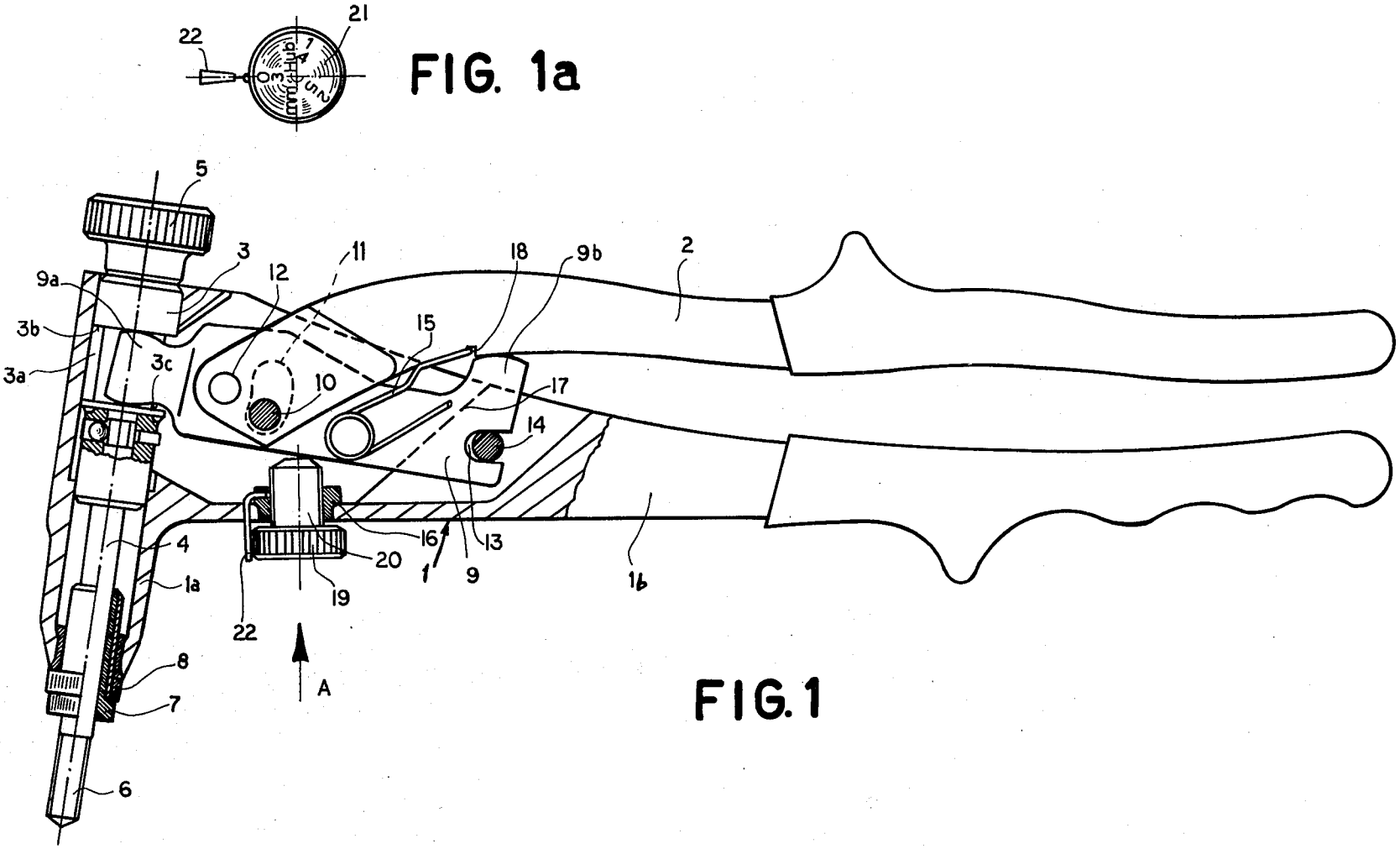
FIG. 1 is an elevational view of a first embodiment of the manual riveting tongs of the invention shown in closed position, partially in section.
FIG. 1*a* is a view in the direction of the arrow A of FIG. 1 of the stop screw of the invention provided with the stroke scale, in the position shown in FIG. 1.
Figure 2A:
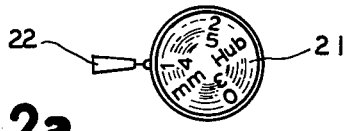
FIG. 2*a* is a view of the stop screw bearing with the stroke-scale in the position in accordance with FIG. 2.
Figure 2:
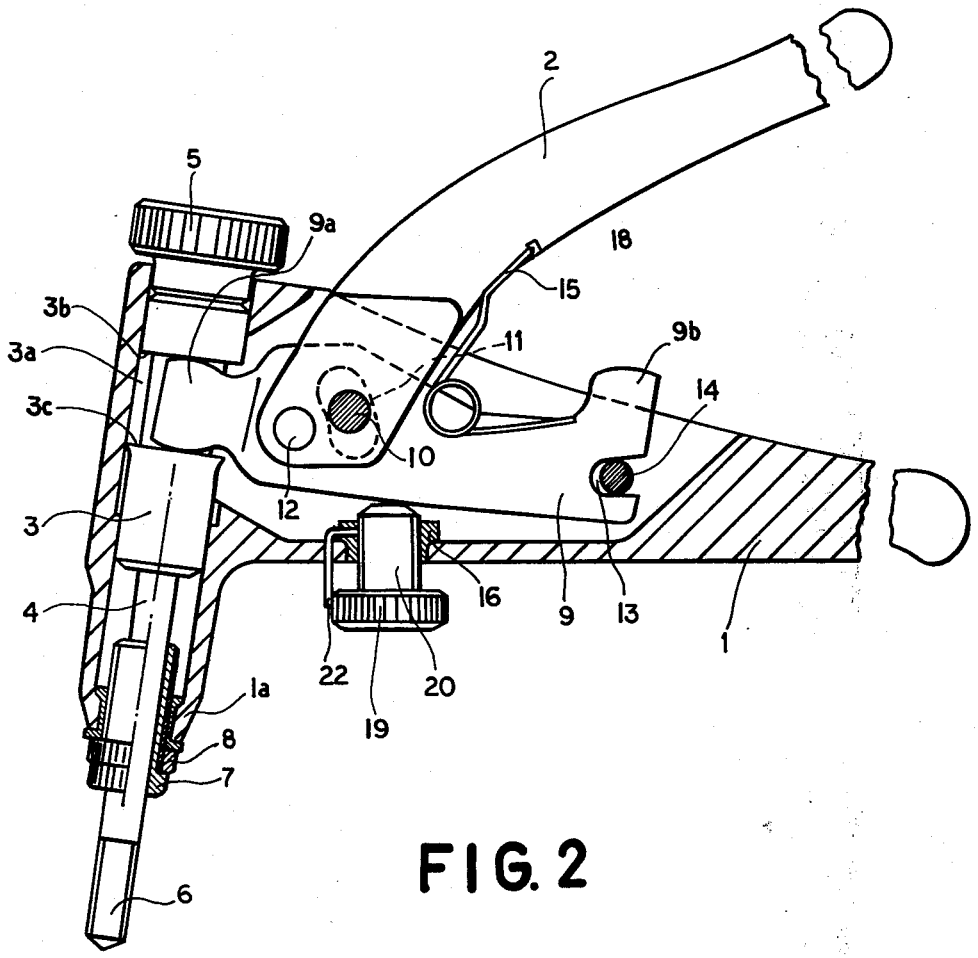
FIG. 2 is a longitudinal section through the head end of the manual riveting tongs of FIG. 1 in the open position thereof.

As shown in FIGS. 1 and 2, the manual riveting tongs or pliers comprise the housing 1, which terminates in the stationary arm 16 and the movable arm 2 which is the force-applying arm. At its front or working end, the housing has the configuration of the striking part of a hammer, i.e. a hammerhead configuration 1*a*. This head 1*a*; has its vertical axis inclined to the horizontal axis of the remainder of housing 1, so that closer access to the place of riveting is made possible. The head 1*a* is the guide for the pull mechanism for the setting of blind-rivet nuts. This pull mechanism consists of a pull piece 3 which is displaceable axially in the head 1*a* and has a central bore 1*a*′ through which a pull rod 4 is inserted from the rear, i.e. from the end of the head part 1*a* facing away from the place of riveting. The rod 4 is connected with the pull piece 3 by a clamping connection in accordance with the invention. At its rear end the pull rod 4 is provided with a knurled nut 5 which closes off the head 1*a* in the inserted position of the pull rod 4; the front end of the pull rod 4 terminates in a threaded mandrel 6 which extends out from the front open end of the head part 1*a*, i.e. the end facing the place of riveting. A mouthpiece 7 is screwed into the front end of the head part 1*a* and can be retained by means of a lock nut 8 in various axial positions with respect to the pull rod 4 and the threaded mandrel 6. The blind-rivet nut which is to be set can then be screwed onto the threaded mandrel 6.

Between the side walls of the housing 1 which is forked in U-shape at its front end a lever 9 is arranged as intermediate member in the embodiment shown. The front or working end 9*a* of the lever 9 is of fork shape and extends into a recess 3*a* on the circumference of the pull piece 3, the shoulders 3*b*, 3*c* produced by the recess 3*a* forming stops or attack surfaces for the lever 9. The rear, free end of the lever 9 is formed as a stop 9*b* for the movable arm 2 at the end of a riveting process.

The movable arm 2 is pivoted on the housing 1 by means of the bolt 10 which passes through a slot 11 in the lever 9. The slot 11 is a curved slot making possible the stroke movement of the lever 9. By means of the bolt 12, the movable arm 2 is articulated to the lever 9. At its free, rear end, the lever 9 has a slot 13 into which there extends another bolt 14 so that the lever 9 is displaceably articulated here to the housing 1. A spring 15 which is bent in U shape has, arms which are circularly wound several times on both sides of the lever 9 and two open ends resting on both sides of the lever 9 against obliquely extending steps 17 in the tongs housing 1. The end of the spring is bent in U shape and rests in a notch 18 on the bottom of the movable arm 2, to urge the manual riveting tongs into its open position.

In the bottom of the forked tong housing 1 of U shape, in the region between the bolts 10 and 14 of the lever 9 there is recessed a threaded bushing 16 into which, in accordance with the invention, there is screwed a stop screw 20 provided with a knurled nut 19 (locking means). This stop screw 20, depending on how far it is screwed in, offers a stop at different heights for the lever 9, as a result of which, in accordance with the invention, the effective stroke upon the actuating of the manual riveting tongs can be changed and fixed in accordance with the thickness of material to be used or the blind rivet nut which has been selected. On front side of the knurled nut 19 a stroke scale 21 is milled or pasted as shown in FIGS. 1*a* and 2*a*. A pin-shaped detent spring 22 extending laterally of the stop screw 20 out of the bottom of the tong housing 1 is in engagement with the ridges of the knurled nut 19 and serves at the same time as an indicating mark for the stroke-scale 21 and to make the movement of the stop screw 20 more difficult so as to prevent undesired displacement of the stop screw 20.

As already mentioned above, the fork-shaped working end 9*a* of the lever 9 extends into a recess 3*a* on the circumference of the pull piece 3 of the pull mechanism which is axially guided in the head part 1*a* and lifts same upon the actuating of the tongs when the movable tongs arm 2 turns with respect to the tong housing 1 around the bolt 10 upon the actuating stroke, it being swung around the bolt 14 by the force acting between the tongs arm 2 and the lever 9 on the articulated connection produced by the bolt 12 with respect to the tong housing 1.

Specific thicknesses of material which are to be riveted have associated with them specific sizes of the blind rivet nuts, which in their turn require a specific stroke. By the stop screw 20 with the stroke scale 21 in accordance with the invention, the correct stroke for the nut in question can be set on the tool before the riveting, the manual riveting tongs being first of all completely closed for this purpose and the stop screw 20 brought into zero position with respect to the stroke scale 21. In the zero position of the stop screw 20, the tong is held fast by the latter and can no longer be opened. Thereupon the stop nut 20 is adjusted to the stroke value of the blind-rivet nut which has been selected in accordance with the thickness of the material, which value can be noted from the indications on the package or a separate stroke table, the knurled spring 22 serving as the index mark. The stroke values of the stroke scale 21 can either directly indicate the stroke set or merely correspond thereto. By the force of the opening spring 15, the tongs are now opened by an amount corresponding to the stroke which has been set, i.e. until the lever 9 comes against the stop screw 20 and the starting position of the actuating mechanism is thus established. For a smaller stroke, the tong opens only slightly while for a large stroke it opens to a correspondingly greater extent.

The embodiment of the tongs described having the lever 9 as intermediate piece between the swingable tong arms 2 and the pull piece 3 is to be viewed merely as an example. There is also possible, for instance an embodiment in which the tong arm 2 acts directly on the pull piece 3 and the adjusting of the stroke is effected by means of the stop screw 20 directly on the tongs arm 2.

Figure 3:
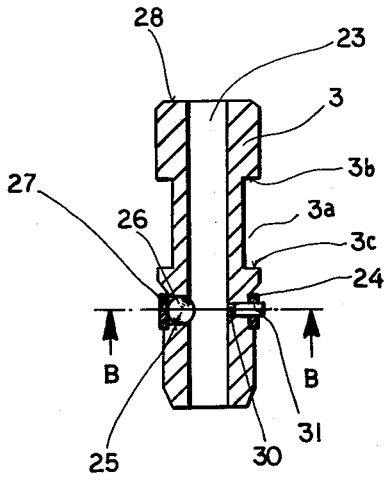
FIGS. 3 to 5 show parts of a first embodiment of the pull mechanism in accordance with the invention for the working of blind rivet nuts, FIG. 3 being a longitudinal section through the pull piece FIG. 4 being a cross section through the pull piece along the line B—B of FIG. 3, and FIG. 5 showing the pull rod with threaded mandrel and knurled nut.
Figure 5:
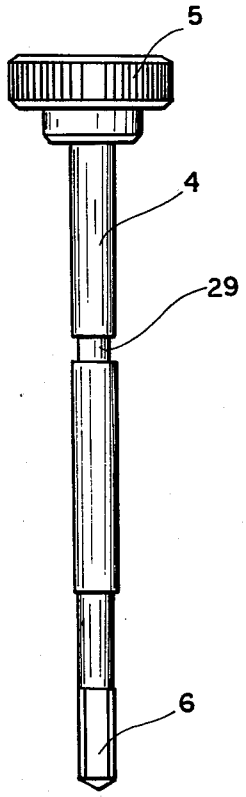
Figure 4:
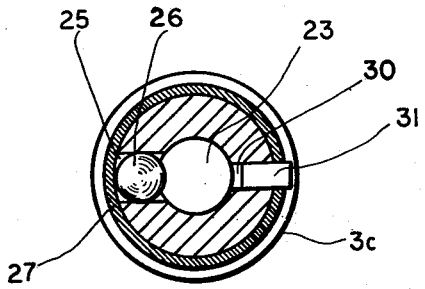

Corresponding to the blind-rivet nut selected, the manual riveting tongs must also be provided with the correct threaded mandrel 6 and the correct nose piece 7. In order to replace the threaded mandrel, the pull rod 4 which bears the threaded mandrel 6 is held by a clamping attachment in the central bore 23 of the pull piece 3 which is axially displaceable in the head part 1*a*. One embodiment of the clamping attachment in accordance with the invention can be seen in FIG. 1 and is shown in detail in FIGS. 3 to 5. The pull piece 3 for this purpose is provided, below the recess 3*a*, where the diameter is somewhat reduced as compared with the slide fit at the upper section, with an annular groove 24 and, at one point of said annular groove, with a bore 25 which receives a ball 26. A leaf spring 27 which forms an open ring surrounds the annular groove 24 and presses the ball 26 inward so that it extends a certain amount into the central bore 23. the pull rod 4 (see FIG. 5), which fits with slight play in the bore 23, is also provided with an annular groove 29 at a distance from its knurled nut 5 which corresponds to the distance of the annular groove 24 from the resting surface 28 for the knurled nut 5 on the pull piece 3.

If the pull rod 4 is pushed into the bore 23 of the pull piece 3, the ball 26 will first be pressed outward by the diameter of the pull rod 4 against the force of the leaf spring 27 until, when in fully inserted position of the pull rod 4, it snaps into the annular groove 29 thereof and thus produces the clamping attachment. In order to replace the pull rod 4 or the threaded mandrel 6 it is merely necessary to strike lightly against the tip of the threaded mandrel 6 in order to push the annular groove 29 again over the ball 26 whereupon the pull rod 4 can be pulled out rearwardly in simple manner. The threaded mandrel 6 therefore need no longer be cumbersomely unscrewed with the use of a tool as is the case in the known apparatus.

In order to secure the clamping attachment described, i.e. to avoid the leaf spring 27 possibly turning and the ball 26 then dropping out at its open place, a second bore 30 of smaller diameter can preferably be provided in the annular groove 24 opposite the ball 26. A pin 31 is then inserted into this bore 30 which is preferably located at the place opposite the ball.

Figure 6:
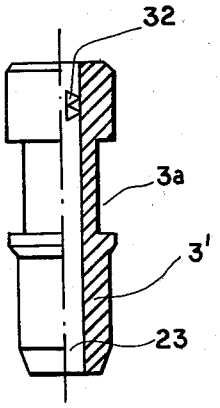
FIGS. 6 to 8 show a second embodiment of the pull mechanism of the invention for the working of blind rivet nuts, FIG. 6 showing the pull piece half in longitudinal section, FIG. 7 showing the threaded mandrel and FIG. 8 being a top view of the snap ring lying in a groove of the pull rod, on a scale of 3:1.
Figure 7:
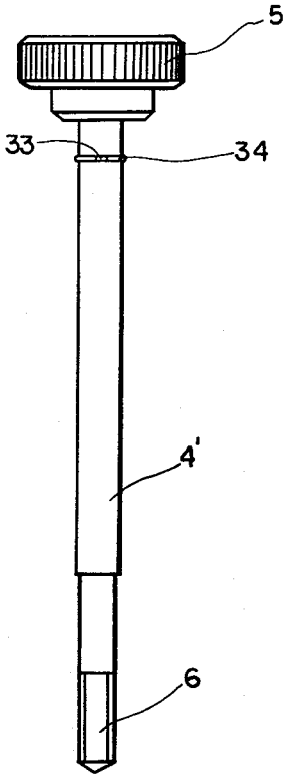
Figure 8:
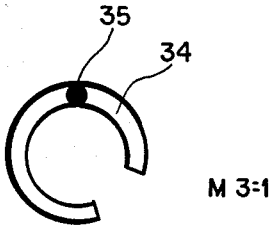

FIGS. 6 to 8 show details of another, simpler embodiment in accordance with the invention of the clamping attachment between the pull piece and the pull rod. In accordance with FIG. 6 no groove is provided on the pull piece 3' alongside the recess 3a; rather the central bore 23 preferably has, in the upper region of the pull piece 3', a fine-machined smooth surface 32. The pull rod 4', as can be noted from FIG. 7, has a narrow annular groove 33 in the region of the fine-machined surface 32, i.e. in this case also in its upper region, into which groove an annular wire spring 34 of circular cross section 35 is inserted, as shown in FIG. 8. The diameter of the annular spring 34 is slightly greater than that of the pull rod 4' which fits with slight play into the bore 23 so that upon the insertion of the pull rod 4' into the pull piece 3' the annular spring 34 is compressed under tension and is clamped fast against the fine-machined wall. In this case also it is sufficient, in order to replace the threaded mandrel 6 or the pull rod 4 bearing same, to strike lightly against the tip of the threaded mandrel 6 in order to push the annular spring 34 out of its clamping region, whereupon the pull rod 4' can be pulled out towards the rear.

It is important that the borehole 23 of the pull piece 3' be adapted in its diameter precisely to the annular spring 34 and finely machined at least in the region in which the annular spring 34, when the pull rod 4' is mounted, comes to lie so that the clamping action is brought about. Where this region lies on the longitudinal axis is fundamentally immaterial, but logically it is in the upper region, since otherwise the annular spring 34 would have to be pulled over the corresponding length of the pull piece 3'.

The riveting is carried out suitably in the following fashion:

(1) First, the thickness of material to be riveted is determined, for instance 2.0 to 3.0 mm.

(2) Corresponding to the thickness of material, the blind rivet nut of correct size is selected, for instance M5 × 7 × 12.5F, Alu.

(3) The threaded mandrel 6 required for the blind rivet nut selected and the corresponding nose piece 7 are determined (for instance 150/151), and the tongs equipped therewith. The nose piece 7 is threaded, with the lock nut 8 screwed on, into the head part 1a of the tongs and the pull rod 4 which bears the correct, threaded mandrel 6 is inserted into the head part 1a from the rear until it strikes the knurled nut 5 on the pull piece 3.

(4) In the manner described above, the correct stroke for the blind rivet nut selected is now set by means of the stop screw 20 of the invention; the tongs open as described by an amount corresponding to the stroke set.

Figure 9:
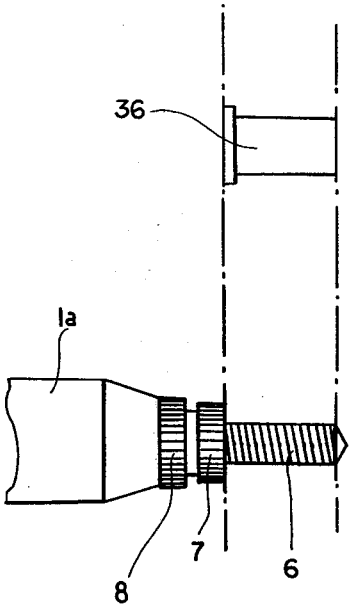
FIG. 9 shows the proper length relationship of the threaded mandrel which extends adjustably out of the mouthpiece of the tong housing with respect to the blind-rivet nut to be used for the riveting.

(5) The blind rivet nut is now screwed onto the threaded mandrel 6; it should be seen to it that the length of the part of the threaded mandrel 6 which extends out of the nose piece 7 corresponds, as shown in FIG. 9, to the length of the blind rivet nut 36 which is to be worked, in order that the threaded mandrel 6 acts on all threads of the blind rivet nut 36 screwed thereon so that the thread will be uniformly loaded during the riveting and will not be damaged. The projecting length of the threaded mandrel 6 is adjusted by screwing the nose piece 7 and locked by means of the lock nut 8 on the head part 1a. For the formation of the bead on the blind rivet nut upon the subsequent riveting, it is advisable, but not necessary, for an unthreaded section 6' of the threaded mandrel 6 still to extend into the blind rivet nut 36, in accordance with FIG. 10a.

Figure 10:
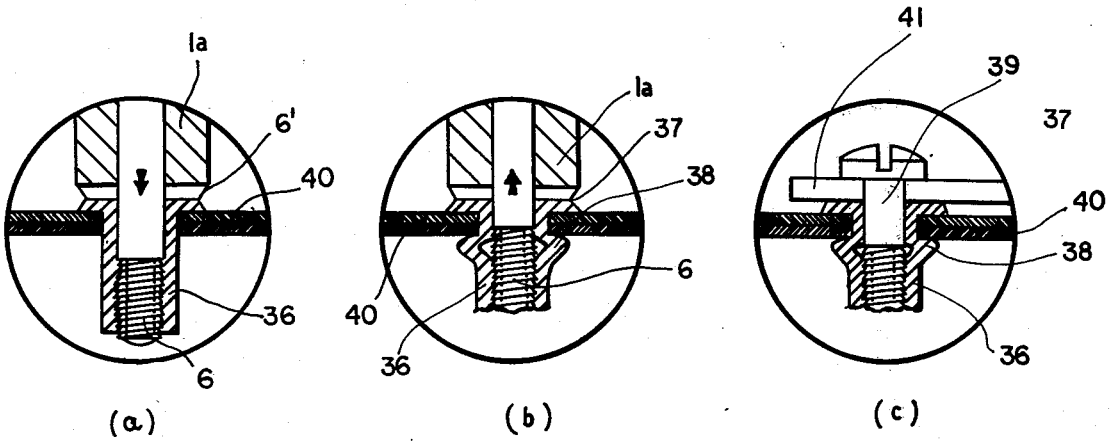
FIGS. 10*a* to 10*c* of riveting with additional screw fastening.

(6) For the riveting, in accordance with FIGS. 10a to 10c, the blind rivet nut 36 screwed onto the threaded mandrel 6 is introduced into the bore of the workpiece 40 provided for the riveting as far as it will go (FIG. 10a). The threaded mandrel 6 with blind rivet nut 36 are held perpendicular to the workpiece 40. The tongs arms are now completely squeezed together and thereby, in the manner already described, by means of the lever 9 the threaded mandrel 6, together with the pull piece 3, is lifted by the amount of the stroke set and the bead 38 is formed by transmission of force via the threads of the threaded mandrel 6 and the blind rivet nut 36, as counterpart to the manufactured head 37 of the rivet, on the opposite side of the workpiece 40 (FIG. 10b). The riveting is now complete, and the threaded mandrel 6 can be unscrewed from the blind rivet nut 36 by means of the knurled nut 5.

Detachable connection of another workpiece 40 to the rivet point thus produced is possible, as shown in FIG. 10c, by means of a screw 39.

Figure 11:
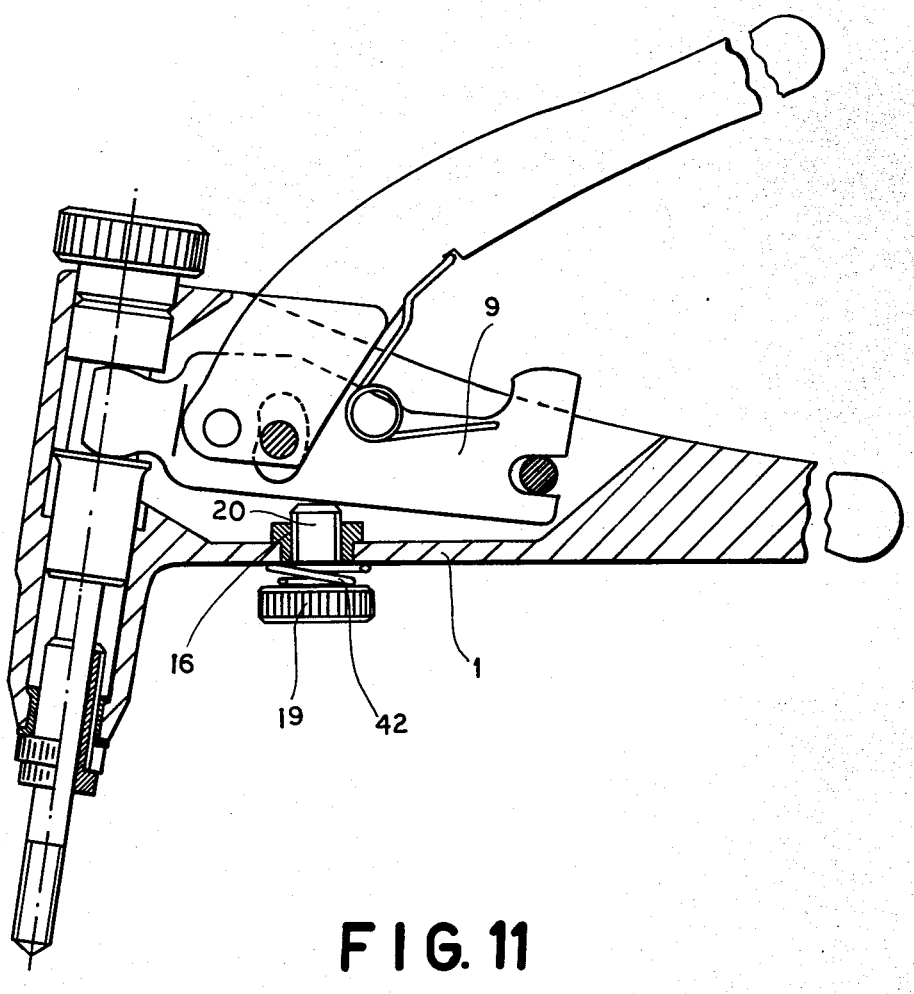
FIG. 11 is a longitudinal section through the head end of a second embodiment of the manual riveting tongs of the invention, shown in its open position.

FIG. 11 shows another embodiment of the stroke setting device in accordance with the invention. Identical parts have been provided with the same reference numbers. In the case of this embodiment also, a threaded bushing 16 is introduced into the bottom of the U-shaped tong housing 1 below the lever 9, the stop screw 20 provided with the knurled nut 19 (locking means) being screwed into same in this case also. Differing from the embodiment described above, in the present case a helically wound coil spring 42 which rests on the one side on the bottom of the tongs housing 1 and on the other side on the bottom of the knurled nut 19 holds the stop screw 20 fast in position against unintended turning. By means of a possibly elastic plastic coating of the coil spring 42 or other suitable means, the stop screw 20 can furthermore be made more difficult to move.

The invention is not limited to the embodiments described above; rather, numerous structural modifications are possible without thereby going beyond the basic concept of the invention.

I claim:

1. A tool for manually setting internally threaded blind-rivet nuts comprising:

a fixed arm formed at one end with a housing having a hammer-shaped head, said head being provided with a bore extending generally transversely of said arm;

a tubular pulling member linearly slidable in said bore;

an externally threaded mandrel adapted to be screwed into a blind-rivet nut and to project from an end of said head, said mandrel being formed on a rod extending into said bore and into said pulling member;

clamping means on an inner surface of said member and an external surface of said rod for clamping said rod to said pulling member, said clamping means being releasable upon the tapping of said mandrel against a surface to enable said rod and said mandrel to be withdrawn from said head through said member;

a movable arm pivotally connected to said fixed arm and operatively connected to said pulling member for displacing said pulling member and said rod to set a blind-rivet nut screwed on to said mandrel upon squeezing of said arms together; and a stroke-limiting screw threaded into said housing and effective to limit the stroke of said movable arm.

2. The tool defined in claim 1 wherein said clamping means includes an annular groove formed on said rod and a circular-cross section spring received in said groove and bearing outwardly upon a finely machined surface of said member.

3. The tool defined in claim 1, further comprising a nose piece threaded into said head at the end thereof from which said mandrel emerges, and a locking nut threaded onto said nose piece for locking same against said head.

4. The tool defined in claim 1 wherein said clamping means includes a spring-loaded inwardly biased ball on said member and an external groove formed on said rod adapted to receive said ball.

5. The tool defined in claim 4 wherein said member is formed with a pair of opposite radial bores, one of said bores receiving said ball, said clamping means including a leaf spring bearing upon said ball and anchored by a pin received in the other radial bore.

6. The tool defined in claim 1 wherein said housing is of generally U shape and receives said movable arm between sides of said housing, the bottom of said housing being provided with an internally threaded bushing, said screw being threaded into said bushing.

7. The tool defined in claim 6 wherein said screw has a head formed with indicia of stroke values, the tool further comprising an index adjacent said head and cooperating with said indicia.

8. The tool defined in claim 6, further comprising a lever received between said walls of said housing and engaging said member, said movable arm being pivotally connected to said lever, said lever being formed with a stop for said movable arm and being engaged by said screw, said lever being provided with an arcuate groove receiving the pivot for said movable arm on said housing.

9. The tool defined in claim 6 wherein said screw has a milled head, said tool further comprising a pin-shaped detent spring projecting from said housing and engaging between ribs of said milled head of said screw for retaining same against rotation.

10. The tool defined in claim 6 wherein said screw has a head, further comprising a coil spring received between said head of said screw and the bottom of said housing.

11. The tool defined in claim 10 wherein said spring is provided with a plastic covering.

* * * * *